United States Patent [19]

Maher

[11] Patent Number: 4,969,349

[45] Date of Patent: Nov. 13, 1990

[54] SYNCHRONIZED DUAL AXIS ACTUATOR

[76] Inventor: John H. Maher, 6742 River Rd., Flushing, Mich. 48433

[21] Appl. No.: 365,202

[22] Filed: Jun. 15, 1989

Related U.S. Application Data

[63] Continuation-in-part of Ser. No. 210,368, Jun. 23, 1988, Pat. No. 4,887,446.

[51] Int. Cl.[5] ..... B21J 13/08

[52] U.S. Cl. ..... 72/405; 198/621; 414/750; 91/508; 60/473

[58] Field of Search ..... 72/405, 421, 453.02; 198/621; 414/750, 751; 91/508, 516; 60/473; 254/89 H, 93 R

[56] References Cited

U.S. PATENT DOCUMENTS

| | | | |
|---|---|---|---|
| 1,878,738 | 9/1932 | Warner | 254/89 H |
| 1,994,974 | 3/1935 | Wiedmann | 91/516 |
| 2,220,815 | 11/1940 | Feilcke | 254/93 R |
| 2,942,848 | 6/1960 | Friesen | 254/89 H |
| 3,028,727 | 4/1962 | Anston | 60/473 |
| 3,757,961 | 9/1973 | Jacobs | 214/1 BB |
| 4,361,413 | 11/1982 | Toda | 414/752 |
| 4,404,837 | 9/1983 | Allen et al. | 72/349 |
| 4,428,221 | 1/1984 | Owens | 72/405 |
| 4,511,029 | 4/1985 | Okawa | 198/621 |
| 4,607,516 | 8/1986 | Schafer et al. | 72/405 |
| 4,627,253 | 12/1986 | Tennessen et al. | 72/4 |
| 4,658,626 | 4/1987 | Yamada et al. | 72/405 |
| 4,697,449 | 10/1987 | Harsch et al. | 72/405 |
| 4,735,303 | 4/1988 | Wallis | 198/621 |
| 4,785,657 | 11/1988 | Votava | 72/405 |

FOREIGN PATENT DOCUMENTS 56-74330 6/1981 Japan .

*Primary Examiner*—Daniel C. Crane
*Attorney, Agent, or Firm*—Krass & Young

[57] ABSTRACT

A dual axis actuator consisting of two fluid cylinders having the fluid inputs to the cylinders connected in parallel to a source of pressurized fluid, resulting in an automatic sequencing of cylinder rod drives. The cylinder rod encountering the least resistance to motion extends first until it reaches a stop, followed by the extension of the second cylinder rod. In the preferred embodiment of the invention, the source of fluid input to the two fluid cylinders is derived from the fluid port of a third fluid cylinder having its cylinder rod driven by an external power source. By utilizing two port fluid cylinders, the dual axis actuator can be adapted to provide a sequence of drives for powering workpiece transferring units in a multiple workstation transfer press. Such a system provides an automatic sequencing of translations for engaging and lifting workpieces for movement to a subsequent work station, followed by lowering and retracting from workpieces to allow the next stroke of the press.

13 Claims, 4 Drawing Sheets

SYNCHRONIZED DUAL AXIS ACTUATOR

CROSS-REFERENCE TO RELATED APPLICATIONS

This application is a continuation-in-part of pending application Ser. No. 210,368, filed on June 23, 1988, now U.S. Pat. No. 4,887,446, issued 12-19-89 entitled "System for Transferring Workpieces through a Series of Work Station."

BACKGROUND OF THE INVENTION

1. Field of the Invention

The present invention relates generally to actuators having an automatic sequence of translational motions and more particularly, to a self synchronizing dual axis actuator for driving workpiece transferring mechanisms of automated multiple workstation systems.

2. Description of the Related Art

Automated multiple work station systems have gained wide acceptance in the manufacturing industries due to their economical operation and high productivity. The multiple work station approach involves the automatic transfer of a workpiece through a series of stations whereby a sequence of operations are carried out to form a completed product.

The efficiency of the multiple work station approach depends to a large degree upon the mechanism used to transfer workpieces between the stations. Typically, the transferring mechanism is required to engage and lift a workpiece, move to the next workstation, and then lower and release the workpiece so the succeeding step in the manufacturing process can commence. Examples of prior art transferring mechanisms utilized in multiple work station transfer presses can be found in U.S. Pat. Nos. 4,627,253, 4,653,311, and 4,785,657.

The primary disadvantages associated with current workpiece transferring mechanisms are a consequence of the complexity of the actuators used for driving and controlling the transfer mechanisms. Conventional actuators depend upon complicated arrangements of electrical, mechanical, or fluid devices integrally formed into the processing equipment of the work station. These complex mechanisms are expensive and make the repair and servicing of multiple work station systems difficult.

Consequently, a need exists for less complicated actuators for driving workpiece transferring mechanisms to facilitate the repair and maintenance of multiple work station manufacturing systems.

SUMMARY OF THE INVENTION

The present invention is directed toward providing a synchronized dual axis actuator for driving and controlling elements, without complicated arrangements of gears, cams or other devices generally required to achieve mechanical timing, or complex electronic servomechanisms.

In its broadest form, the present invention consists of a pair of fluid cylinders adapted to drive an element or plural elements along two paths which provide different resistances to movement. The fluid inputs to the two cylinders are connected in parallel to a single fluid source, preferably the fluid output of a third cylinder having its piston driven by an independent power source. As the source outputs fluid, the driven element will first be moved along the path providing the least resistance until the element reaches a stop. Once the stop is reached, movement along the second path begins, since that path then provides the least resistance to movement. In this manner, the dual axis actuator automatically achieves sequencing of its driving forces, without the need for additional timing apparatus.

The preferred embodiment of the present invention takes the form of a dual axis actuator for driving the workpiece transferring mechanism of a multiple work station transfer press. The sequence of translational motions provided include engaging and lifting a workpiece, then lowering and retracting, once the workpiece has been translated to the next work station. Synchronization of the these movements results from the differing resistance to motion when engaging, lifting, lowering, and retracting from the workpiece.

The present invention provides the advantages of economy and ease of maintainance due to its mechanical simplicity and its self synchronizing feature. It can easily be adapted to transferring mechanisms which have been modularized into individual units and separated from the multiple work station process. Synchronism of all modular transferring units can be accomplished simply by utilizing a single source of pressurized fluid to drive all actuators.

BRIEF DESCRIPTION OF THE DRAWINGS

The invention will be more fully understood by reference to the following detailed description and accompanying drawings in which.

DESCRIPTION OF THE PREFERRED EMBODIMENTS

Figure 1:
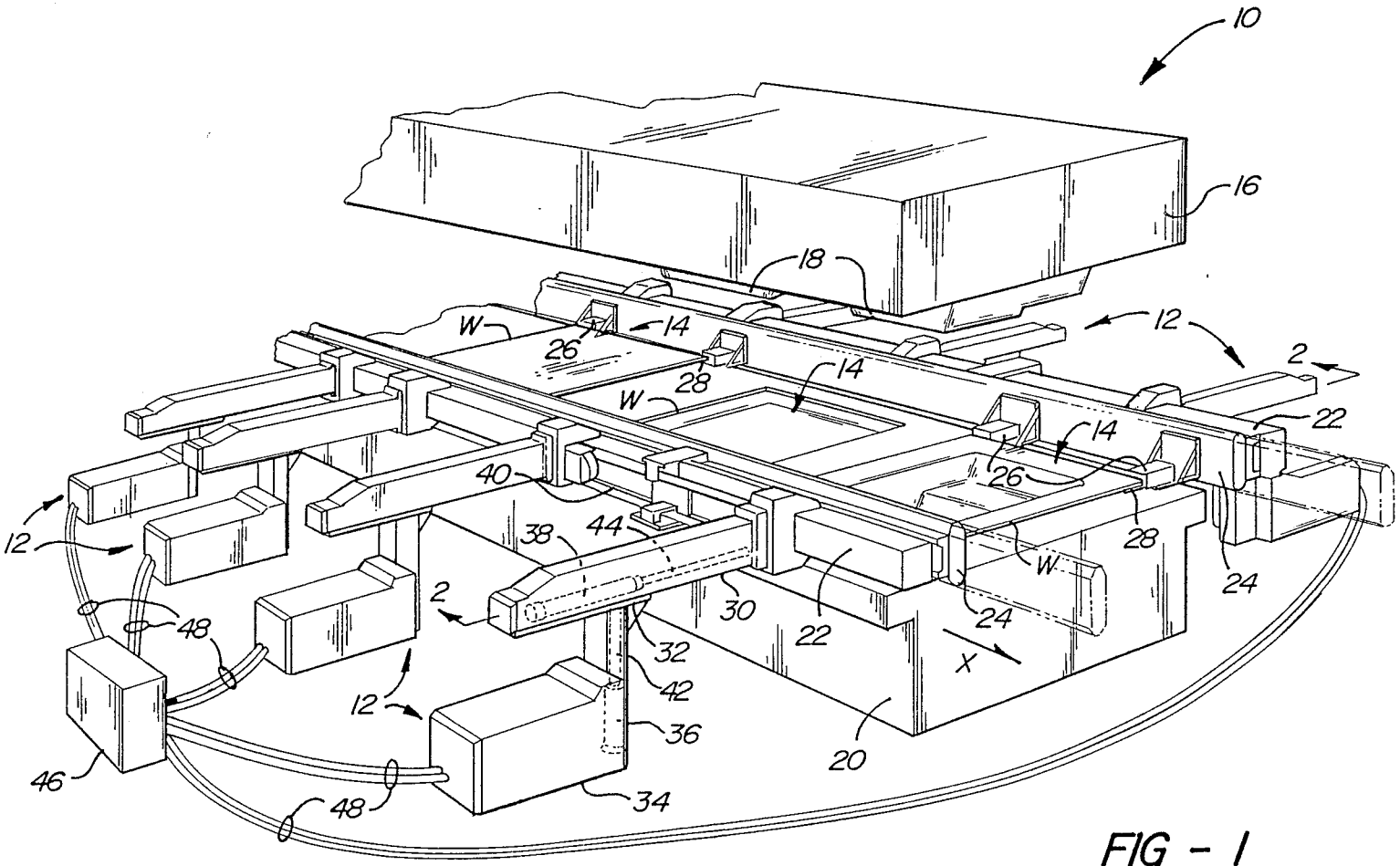
FIG. 1 is a perspective view of a transfer press having the present invention installed in modularized transferring units, with an alternative extended position in the X direction shown in phantom.

The present invention preferably takes the form of a dual axis actuator for driving individual workpiece transferring units of a transfer press as illustrated in FIGS. 1 to 4. While this embodiment of the invention is shown in the drawings and described in detail herein, the invention is susceptible of embodiment in many different forms. It should be understood that the present disclosure is to be considered exemplification of the principles of the invention and is not intended to limit the invention to the embodiment illustrated.

Figure 2:
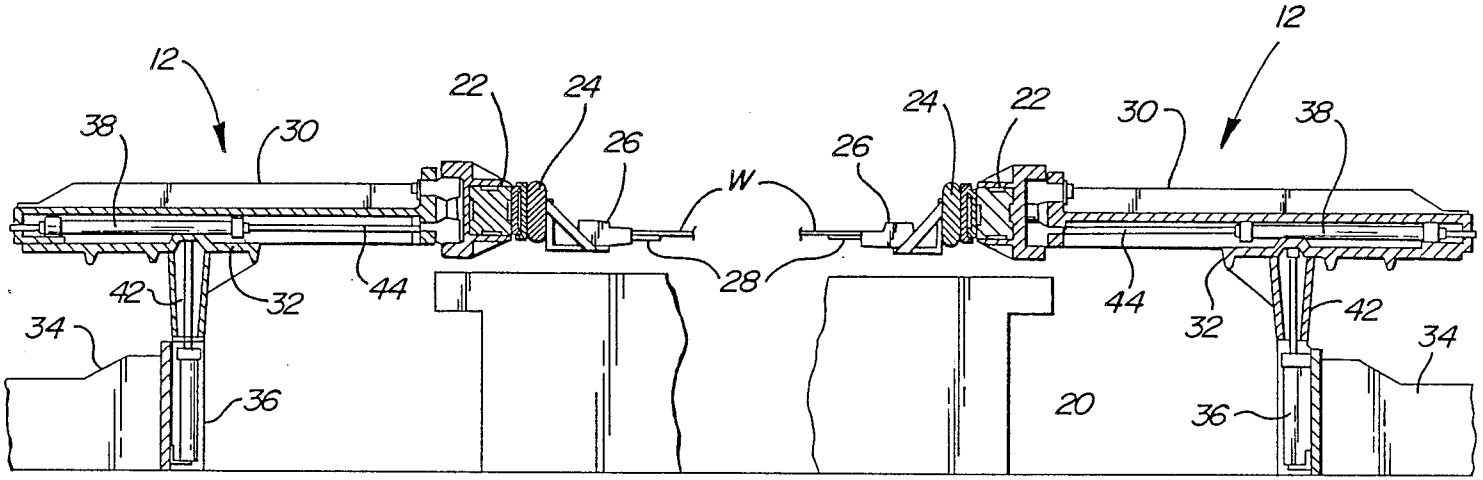
FIG. 2 is a cross section along line 2—2 of FIG. 1 showing details of the present invention as installed in the transferring units of the transfer press.

Referring now to FIGS. 1 and 2, there is shown a multiple workstation transfer press generally designated as 10 and having a plurality of modularized workpiece transferring units generally designated as 12. The transfer press 10 has a number of workstations generally designated as 14 where a series of stamping operations are performed on a succession of workpieces W. A ram 16 supports a plurality of upper die halves 18 with the associated lower die halves, not shown, but supported by the bolster 20 and located under each work piece W.

The transfer press 10 has a pair of parallel transfer rails 22 extending longitudinally along both sides of the work stations 14, which are equally spaced along the X direction. Finger operator rails 24 are slidably attached to transfer rails 22 to permit reciprocal motion along the X direction. A plurality of fingers 26 are attached to the finger operator rails 24, with each finger 26 terminating in a workpiece engaging section 28 for holding a corner of a workpiece W. By means of the powered belt system 40, located within each transfer rail 22, the finger operator rails 24 may be translated along the X direction as shown in phantom in FIG. 1. This enables the workpieces W to be moved to the successive work stations 14 of the transfer press 10.

Each workpiece transferring unit 12 has a transfer carriage 30 to provide support for the transfer rails 22. Each transfer carriage 30 is slidably mounted to a carriage support 32, which inturn is slidably mounted to the base 34 of a transferring unit. According to the perferred embodiment of the present invention, the dual axis actuator for driving each workpiece transferring unit 12 consists of a lifting fluid cylinder 36 and a translating fluid cylinder 38. The lifting fluid cylinder 36 is attached to the transferring unit base 34 and its cylinder rod 42 is connected to the carriage support 32. The translating fluid cylinder 38 is attached to the carriage support 32 and its cylinder rod 44 is connected to the transferring carriage 30.

Figure 3:
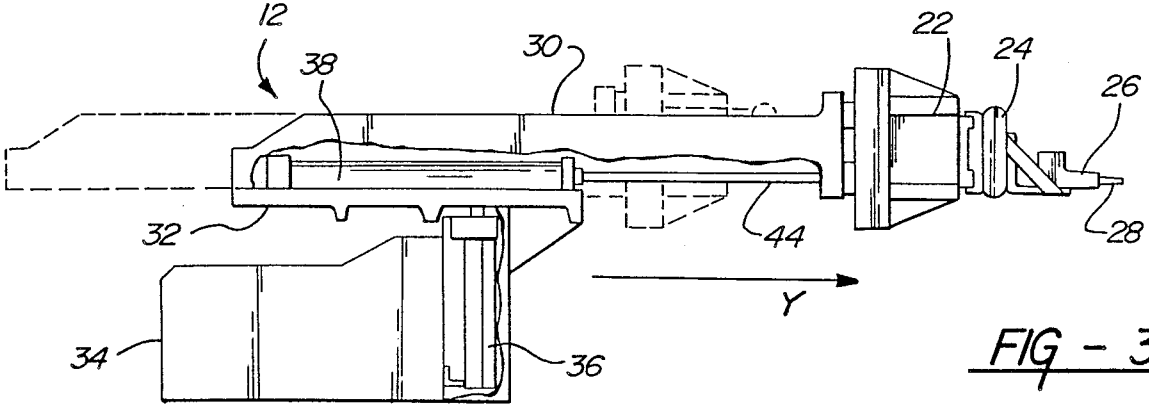
FIG. 3 is an end on view of a transferring unit with certain portions shown in phantom to indicate the direction of movement in the Y direction.
Figure 4:
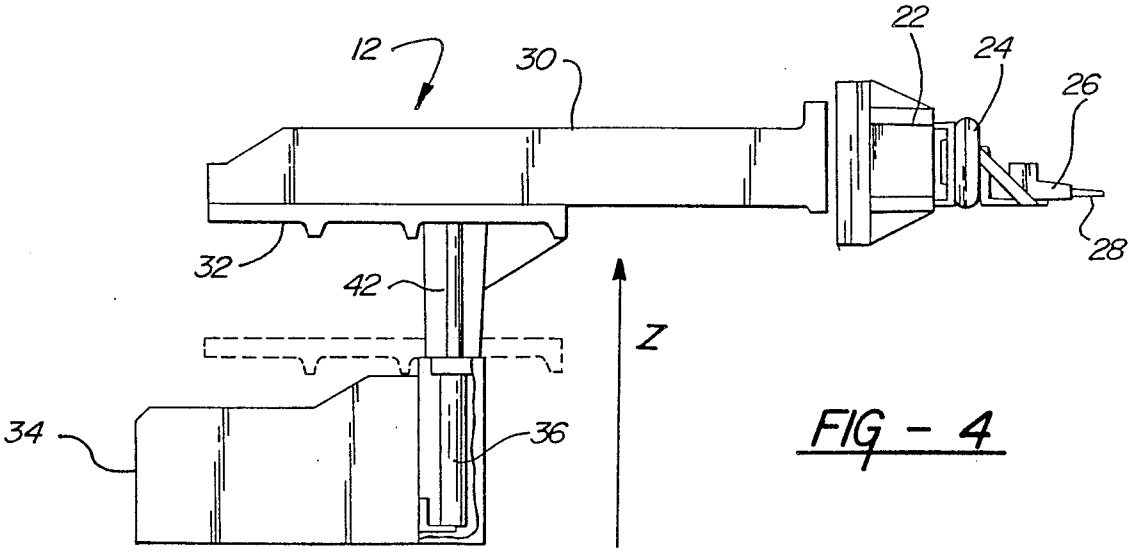
FIG. 4 is an end on view of a transferring unit with certain portions shown in phantom to indicate direction of movement in the Z direction.

Referring now to FIGS. 3 and 4, the operation of the dual axis actuator for driving a transferring unit will be described. By extending rod 44 of the translating fluid cylinder 38, transfer carriage 30 is moved in the Y direction with respect to the carriage support 32. The solid lines of FIG. 3 show the transfer carriage 30 in the engaging position, with the retracted position shown in phantom. The action of the lifting fluid cylinder 36 and its rod 42 in moving the transfer carriage 30 and carriage support 32 in the Z direction is shown in FIG. 4. The solid lines show transfer carriage 30 in its highest position with the lower position shown in phantom. Movement of the transfer carriage 30 in the Y and Z directions causes the transfer rail 22, finger operator rail 24, and the plurality of fingers 26 to move correspondingly. These translations provide the required movements for engaging and lifting workpieces W, before translation in the X direction to the next work station 14, followed by lowering and retracting from the workpieces W, to enable clearance for the next stroke of the press.

Synchronization of all the modularized transferring units 12 is achieved by utilizing a centralized control unit 46 to provide pressurized fluid through fluid conduit 48 to drive each individual lifting fluid cylinder 36 and translating fluid cylinder 38 in the workpiece transferring system.

Figure 5:
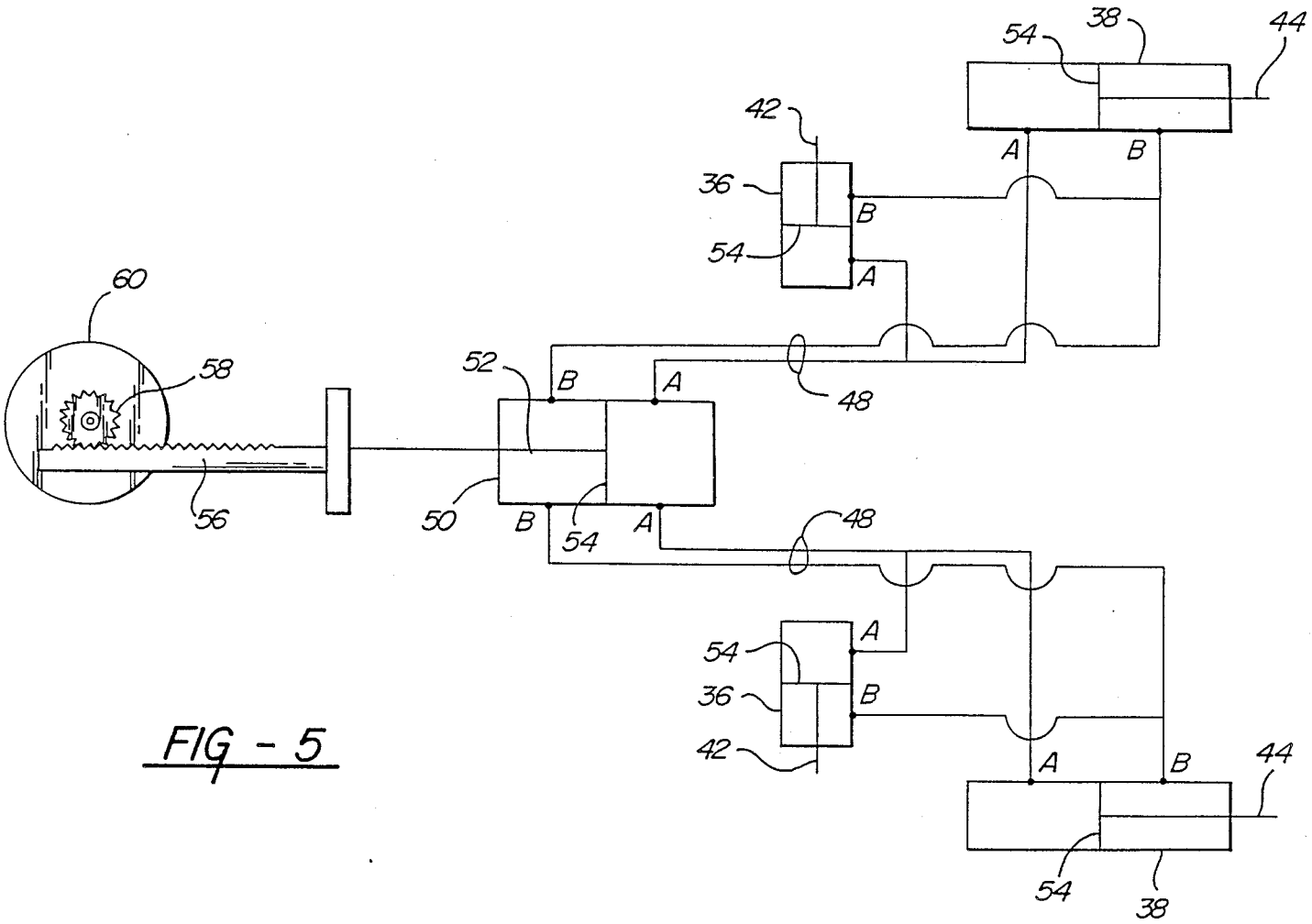
FIG. 5 is a sectional schematic view illustrating a fluid circuit for use with the present invention.

Schematically shown in FIG. 5 are the lifting fluid cylinders 36 and translating fluid cylinders 38 for driving two different workpiece transferring units 12 described previously. Also shown is a source fluid cylinder 50 with cylinder rod 52 attached to a rack 56 and pinion gear 58. A rotary motor 60, operating through a rack 56 and pinion gear 58 provides reciprocal motion to cylinder rod 52 of source fluid cylinder 50.

The lifting fluid cylinder 36 and translating fluid cylinder 38 have fluid ports A and B disposed on opposite sides of their pistons 54, each of which are connected to similarly denoted ports on each side of source cylinder 50.

As piston 54 of source cylinder 50 is driven toward its fluid ports denoted by A, fluid is forced out of each port. A to drive each set lifting fluid cylinders 36 and translating fluid cylinders 38. Initially, rods 44 of the translating cylinders 38 encounter much less resistance to movement than do the rods 42 of the lifting fluid cylinders 36, due to the weight of the transfer rails 22, finger operator rails 24, and the fingers 26 for engaging workpieces W, which bear down upon and must be raised by the lift cylinders 36. As a consequence, the rods 42 of the translating cylinders 38 first extend causing the fingers 26 to engage the workpieces W. Once the rods 44 of the translating cylinders 38 are fully extended, the rods 42 of the lifting cylinders 36 extend due to the now lesser resistance acting against their motion. This results in the lifting of the transfer rails 22, finger operatior rails 24, and the fingers 26 holding the workpieces W.

During the second half of the cycle, rod 52 of the source fluid cylinder 50, is forced toward the fluid ports denoted by B, due to the rotary motor 60 acting through the rack 56 and pinion gear 58. Fluid is thus forced out of the fluid ports denoted B into fluid conduit 48 which feeds the fluid ports B of the translating fluid cylinder 38 and the lifting fluid cylinder 36. During this part of the cycle, the weight of transfer rails 22, finger operator rails 24, fingers 26, and associated workpieces W, assist in the retraction of the rods 42 of the lift cylinders 36. Because there is less resistance to the movement, the rods 42 of lifting cylinders 36 retract first, followed by the retraction of the rods 44 of the translating cylinders 38. Thus, the transferring mechanism lowers the workpieces W and then retracts the fingers 26.

In the preferred embodiment of the invention, a single source cylinder 50 is used to supply fluid to all sets of lifting fulid cylinders 36 and translating fluid cylinders 38 located in the different transferring units 12. This results in an automatic syncronization of all transferring units of the transfer press without gears, cams, complicated mechanical timing devices, or complex electronic sermomechanisms.

Rather than using a single source cylinder 50, as shown in FIG. 5, a series of smaller diameter source cylinders can be used, each one driving a transferring fluid cylinder 38 and a lifting fluid cylinder 36. Synchronization can be achieved by simultaneously driving all source cylinder rods 52 with rack 56.

In the preferred embodiment of the present invention, all fluid cylinders are single rod ended. In other embodiments of the invention, all single rod ended fluid cylinders can be replaced with double rod ended cylinders which have rods extending out of each cylinder end. Such single and double ended rod cylinders are commercially available and well known to those skilled in the art. The arrangement of fluid cylinders must be such that the fluid displaced by the motion of the piston of one cylinder fills the volume displaced in the connecting cylinder. Alternatively, fluid accumulators may be used between cylinders producing differing fluid displacements.

I claim:

1. A sequential dual axis actuator for driving at least one element over two directionally fixed axes, one axis being generally horizontal and the other axis generally vertical, the element experiencing different resistance to motion along each axis, said actuator comprising:

a first fluid cylinder having a single input fluid port and an internal piston and cylinder rod drivingly connected to said element to move it along said one axis;

a second fluid cylinder having single input fluid port connected in parallel with said first cylinder input fluid port and an internal piston and cylinder rod drivingly connected to said element to move it along said other axis;

said first cylinder piston, and cylinder rod constructed to initially operate with less resistance against motion than said second cylinder piston, and cylinder rod;

fluid source means connected to said input ports of said first and second fluid cylinders providing the fluid to both cylinders under the same pressure, whereby that cylinder rod experiencing the least resistance to movement extends until its resistance to motion increases beyond that of the other cylinder rod, followed by the extension of the other cylinder rod; and said first and second cylinder independently operably such that operation of said piston and cylinder rod of said first cylinder does not change the axis of operation of said piston and cylinder rod of said second cylinder.

2. A sequential dual axis actuator is recited in claim 1, wherein said fluid source means further comprises:

a third fluid cylinder having an internal piston and rod with a fluid output port connected to the parallel combination of fluid inputs of said first and second cylinders; and means for forcing fluid through the output port of said third fluid cylinder.

3. A sequential dual axis actuator as recited in claim 2, wherein said means for forcing fluid through the output of said third fluid cylinder further comprises:

a rack coupled to the rod end of said third fluid cylinder;

a pinion gear engaging the rack; and a rotary motor having a shaft for turning said pinion gear, whereby the rod and piston of said third cylinder can be translated toward its output port to provide a source of fluid under pressure.

4. A dual axis actuator providing an automatic sequence of translational motions, said actuator comprising:

a first fluid cylinder having a piston and attached rod, with first and second fluid ports disposed on opposite sides of the piston;

a second fluid cylinder having a piston and attached rod, with first and second fluid port disposed on opposite sides of the piston;

said first cylinder, piston and rod constructed to initially operate with less resistance against motion than said second cylinder, piston, and rod;

a third fluid cylinder having a piston and attached rod, with first and second fluid ports disposed on opposite sides of the piston;

conduit means for connecting the first fluid ports of said first, second and third cylinders;

conduit means for connecting the second fluid ports of said first, second and third cylinders;

means for reciprocatingly driving the rod end of said third cylinder in a forward and return stroke, whereby during the forward stroke the same fluid pressure is provided to said first fluid ports of said first and second cylinders, and, when the rod of said second cylinder acts against a greater resistance to movement relative tot he rod of the first cylinder, the rod of said first cylinder extends until it reaches a stop, follow by the extension of the rod of said second cylinder, and during the return stroke the same fluid pressure is provided to said second fluid ports of said first and second cylinders and, the rod of said second cylinder retracts due to a greater biasing force promoting its movement in the retracting direction relative to the rod of the first cylinder, followed by retraction of the rod of said first cylinder; and said first and second cylinders independently operably such that operation of said piston and rod of said first cylinder does not change the axis of operation of said piston and rod of said second cylinder.

5. A dual axis actuator for providing a sequence of horizontal and vertical translations to a workpiece transferring unit for translating workpieces between a plurality of workstations disposed along a transfer press, said actuator comprising:

a first fluid cylinder having a piston and a rod, with first and second fluid ports disposed on opposite sides of the piston, said first fluid cylinder being disposed for substantially horizontal cylinder rod movement;

means for coupling horizontal rod movement from said first cylinder to the workpiece transferring unit of the transfer press;

a second fluid cylinder having a piston and a rod, with first and second fluid ports disposed on opposite side of the piston, said second fluid cylinder being disposed for substantially vertical cylinder rod movement;

means for coupling vertical rod movement of said second cylinder to the workpiece transferring unit the transfer press;

a third fluid cylinder having a piston and a rod, with first and second fluid ports;

conduit means connecting the first fluid ports of said first, second, and third fluid cylinders;

conduit means connecting the second fluid ports of said first, second, and third fluid cylinders;

said first cylinder, piston and rod constructed such that its initial resistance against motion is less than said second cylinder, piston, and rod which has the weight of said transferring unit added to its initial resistance; and means for reciprocatingly driving the rod of said third cylinder, whereby for each cycle of reciprocation the same fluid pressure is supplied to the first fluid ports, the rod of said first cylinder initially extends due to the lesser resistance acting against its movement relative to the rod of said second cylinder, followed by the same fluid pressure being supplied to the second fluid ports and the extension of the rod of said second cylinder, next followed by the retraction of the rod of said second cylinder due to the weight of the transferring unit bearing upon it, finally followed by the retraction of the rod of said first cylinder.

6. A dual axis actuator as recited in claim 5, wherein horizontal rod movement of said first cylinder is coupled to a workpiece engaging mechanism of the transfer press and vertical rod movement from said second cylinder is coupled to a workpiece lifting mechanism of the transfer press, whereby the reciprocating rod motion of said third cylinder produces the sequence of engaging the workpiece, followed by lifting the workpiece, next followed by lowering the workpiece, and finally followed by releasing the workpiece.

7. A dual axis actuator as recited in claim 6, wherein means for reciprocating the rod of said third cylinder further includes:

a rotary motor;

a rack coupled to the rod end of said third cylinder; and a pinion gear engaging the rack and mounted to the shaft of said rotary motor, whereby the reciprocal translation of the rod of said third cylinder is controlled by the rotary motor.

8. A dual axis actuator as recited in claim 7, further including a controller for synchronizing the workpiece engaging, lifting, lowering, and disengaging actions resulting from said actuator with the transfer press mechanism acting to transfer workpieces between work stations.

9. A transfer press of the type having series of equally spaced work stations aligned linearly along an axis with at least one transfer rail extending longitudinally along one side of said work stations in parallel spaced relation to said axis, said transfer rail having a plurality of workpiece engaging fingers extending laterally in a direction toward said axis, and at least one dual axis actuator for providing a sequence of horizontal and vertical translations to a workpiece transferring unit for translating workpieces between said workstations, said actuator comprising:

a first fluid cylinder having cylinder having a piston and a rod, with first and second fluid ports disposed on opposite sides of the piston, said first fluid cylinder being disposed for substantially horizontal cylinder rod movement;

means for coupling horizontal rod movement form said first cylinder to the workpiece transferring unit of the transfer press;

a second fluid cylinder having a piston and a rod, with first and second fluid ports disposed on opposite side of the piston, said second fluid cylinder being disposed for substantially vertical cylinder rod movement;

means for coupling vertical rod movement of said second cylinder to the workpiece transferring unit of the transfer press;

a third fluid cylinder having piston and a rod, with first and second fluid ports;

conduit means connecting the first fluid ports of said first, second, and third fluid cylinders for providing the same fluid pressure in all three first fluid ports;

said first cylinder, piston and rod constructed such that its initial resistance against motion is less than said second cylinder, piston, and rod which has the weight of said transferring unit added to its initial resistance; and means for reciprocatingly driving the rod of said third cylinder, whereby for each cycle of reciprocation, the rod of said first cylinder initially extends due to the lesser resistance acting against its movement relative to the rod of said second cylinder, followed by the extension of the rod of said second cylinder, next followed by the retraction of the rod of said second cylinder due to the weight of the transferring unit bearing upon it, finally followed by the retraction of the rod of said first cylinder;

horizontal rod movement of said first cylinder is coupled to a workpiece engaging mechanism of the transfer press and vertical rod movement form said second cylinder is coupled to workpiece lifting mechanism of the transfer press, whereby the reciprocating rod motion of said third cylinder produces the sequence of engaging the workpiece, followed by lifting the workpiece, next followed by lowering the workpiece, and finally followed by releasing the workpiece;

said actuator coupled to said transfer rail, whereby said actuator drives said transfer rail to produce a sequence of translations for engaging and lifting workpieces for transfer to the next work station, followed by lowering and releasing the workpieces once said workpieces have been translated to said next workstation.

10. A transfer press as recited in claim 9, wherein said means for reciprocating the rods of said plurality of third cylinders further includes:

a rotary motor;

a rack coupled to the rod ends of all third cylinders; and a pinion gear engaging said rack and mounted to the shaft of said rotary motor, whereby the translation of the rods of all third cylinders can be controlled by said rotary motor.

11. A transfer press as recited in claim 9, further including a controller for synchronizing the workpiece engaging, lifting, lowering and releasing actions resulting from each linear actuator with the transfer press mechanism acting to transfer workpieces subsequent work stations between strokes of the press.

12. A transfer press as recited in claim 9, wherein said first, second, and third fluid cylinders of said plurality of dual actuators are of the single rod ended type.

13. A transfer press as recited in claim 9, wherein said first, second, and third fluid cylinders of said plurality of dual actuators are of the double rod ended type.

* * * * *

UNITED STATES PATENT AND TRADEMARK OFFICE

CERTIFICATE OF CORRECTION

PATENT NO. : 4,969,349

DATED : November 13, 1990

INVENTOR(S) : John H. Maher

It is certified that error appears in the above-identified patent and that said Letters Patent is hereby corrected as shown below:

Column 4, Line 36, Please delete "fulid" and insert -- fluid --.

Column 5, Line 68, Please delete "tot he" and insert -- to the --.

Column 7, Line 30, Please delete "cylinder having" (second occurrence)

Column 7, Line 35, Please delete "form" and insert -- from --.

Column 8, Line 15, Please delete "form" and insert -- from --.

Signed and Sealed this

Seventh Day of April, 1992

*Attest:*

HARRY F. MANBECK, JR.

*Attesting Officer*

*Commissioner of Patents and Trademarks*